United States Patent [19]

Golby

[11] Patent Number: 4,579,398

[45] Date of Patent: Apr. 1, 1986

[54] TOWEL DISPENSING APPARATUS

[75] Inventor: John B. Golby, Swannington, Great Britain

[73] Assignee: Glynwed Engineering Limited, Birmingham, England

[21] Appl. No.: 578,667

[22] Filed: Feb. 9, 1984

[30] Foreign Application Priority Data

Feb. 19, 1983 [GB] United Kingdom ..... 8304680

[51] Int. Cl.[4] ..... B65H 19/00

[52] U.S. Cl. ..... 312/38

[58] Field of Search ..... 74/439, 447, DIG. 10, 74/460, 461; 403/344; 226/190, 193; 312/38

[56] References Cited

U.S. PATENT DOCUMENTS

| | | | |
|---|---|---|---|
| 3,339,818 | 9/1967 | Morrow | 226/193 |
| 3,441,463 | 4/1969 | Buck | 226/193 |
| 3,508,773 | 4/1970 | Coberly et al. | 403/345 |
| 3,858,953 | 1/1975 | Bahnsen | 312/38 |
| 3,871,777 | 3/1975 | Sauer | 403/344 |
| 4,170,390 | 10/1979 | McCabe | 312/37 |
| 4,217,061 | 8/1980 | Eiland et al. | 403/344 |

FOREIGN PATENT DOCUMENTS

| | | |
|---|---|---|
| 732768 | 6/1955 | United Kingdom . |
| 1112546 | 4/1966 | United Kingdom . |

*Primary Examiner*—William E. Lyddane
*Assistant Examiner*—Joseph Falk
*Attorney, Agent, or Firm*—McCormick, Paulding & Huber

[57] ABSTRACT

Towel dispensing apparatus (12) comprises a cabinet (10) to house a roll of clean towelling (14), and a take-up roller (36) in cabinet (10) and onto which the towelling is progressively wound during use of the apparatus. Dispensing of the towelling is controlled by a roller mechanism comprising first and second main towel rollers (28, 40). Each of the main towel rollers comprises a tubular body portion (70) end supports (72, 74) and towel-engageable bands (76, 78) providing a friction surface for gripping engagement with a towel to be dispensed. Bands (76, 78) are of natural rubber and mechanically keyed to roller body portion (70). End supports (72, 74) are one-piece plastic mouldings bonded or welded to the plastics material of body portion (70), thereby providing a greatly simplified structure.

1 Claim, 5 Drawing Figures

TOWEL DISPENSING APPARATUS

This invention relates to rollers for use in towel dispensing apparatus such as, for example, towel dispensing apparatus of the kind used in towel-dispensing cabinets employing a roll of towelling which is dispensed from the cabinet in successive portions in response to a pulling action by the user, and the used towelling is likewise continuously taken up into the cabinet. The invention also provides towel dispensing apparatus incorporating such rollers.

In currently available towel dispensing apparatus of this kind the principal dispensing rollers which control the length of towel dispensed in response to a pull by the user, and which also control the take-up of the used towelling, are formed as metal fabrications with a surface layer of emery paper bonded thereto by a suitable adhesive.

Numerous problems arise in relation to these conventional dispensing rollers including manufacturing and assembly problems and performance problems during use of the dispensing mechanism and relating, amongst other things, to inadequate grip by the rollers on the towel being dispensed.

As regards manufacturing problems, these arise partly from the process of bonding the emery paper to the roller body and partly from difficulties in the fabrication process for the roller bodies themselves, particularly the roller end supports which are journalled in bearings carried by the towel cabinet. The bonding of the emery paper is at best a messy job and there is a tendency for pockets of adhesive to form under the emery paper and for the adhesive to spread onto the outer surface of the emery paper and thus to interfere with the proper action of the roller. There is also found to be a tendency for the adhesive joint between the emery paper and the roller body to fail after a period of use, particularly in tropical climates. As regards the roller fabrication process there are often difficulties in attaining a sufficient standard of tolerances in the journalling of the roller, so as to avoid undue eccentric motion of the roller during rotation.

An object of the present invention is to provide towel dispensing apparatus offering improvements in relation to one or more of the above-identified technical problems.

According to the invention there is provided towel dispensing apparatus as defined in the accompanying claims.

In an embodiment of the present invention described below there is provided towel dispensing apparatus in which a roller has a towel-engageable bands drivably coupled to the body of the roller by mechanical drive formations or a friction fit.

The towel-engageable bands on the roller comprise an elastomer. The elastomer is preferably natural rubber. The bands are axially spaced and formed with a surface pattern or tread to improve the grip thereof in relation to the towel. The surface pattern or tread may comprise axially extending ribs and grooves, or flutes.

The bands are each formed with an internal drive formation to co-operate with a complementary formation on the body of the roller. Said internal drive formation may comprise a key or rib member on said band to co-operate with an external groove on the roller body to receive said key or rib. Two or more key or rib members may be provided, preferably 4. The or each rib member extends axially of the roller along only a portion of the axial length of the band.

The main body of the roller itself comprises a polymeric material, such as polyvinylchloride. The main body is in the form of a tube.

End support members for the roller are formed as one-piece mouldings from a polymeric material and having stub shafts to be received in respective bearing assemblies. The end support members are bonded or welded to the body of the tube.

An embodiment of the invention will now be described by way of example with reference to the accompanying drawings in which.

Figure 1:
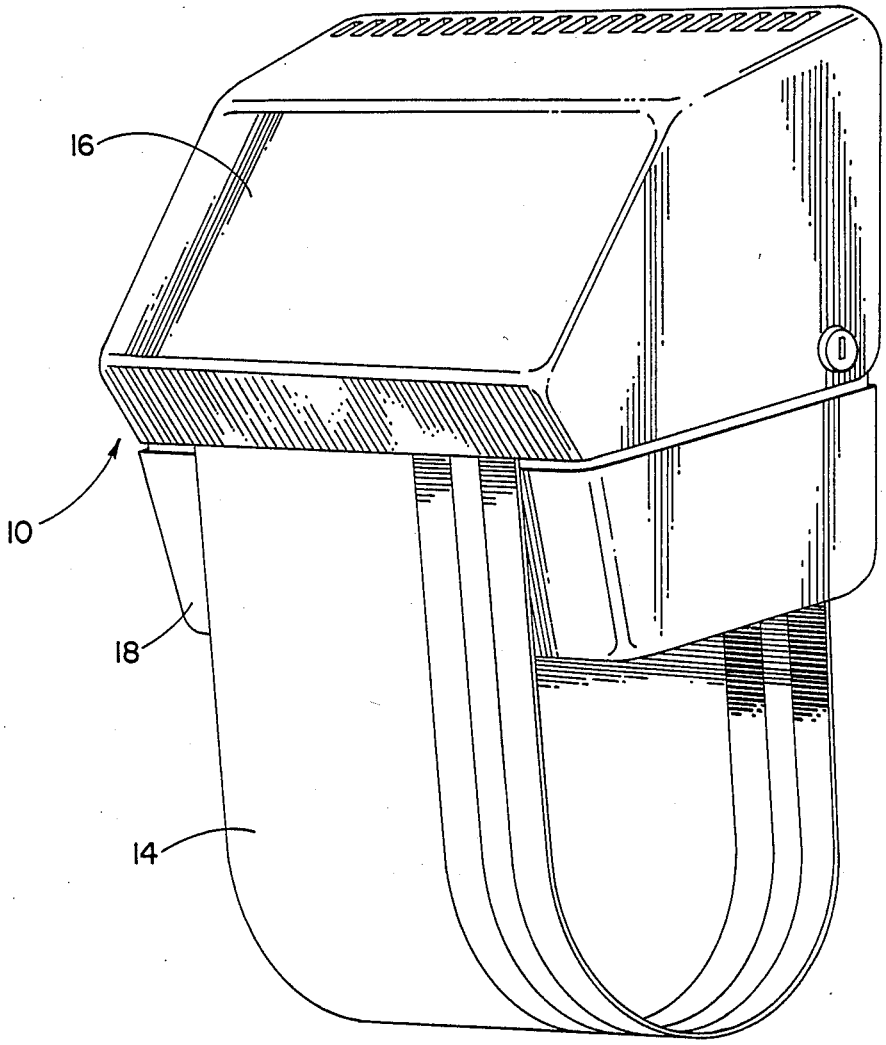
FIG. 1 shows a perspective view of a towel cabinet containing towel dispensing apparatus and showing a loop of towelling ready for use.

As shown in the drawings, a towel dispensing cabinet 10 contains towel dispensing apparatus 12 for dispensing a long roll of towel 14.

Cabinet 10 comprises hinged upper and lower cabinet portions 16, 18 respectively which are openable to permit new and used rolls of towelling to be inserted into and removed from the cabinet.

Figure 2:
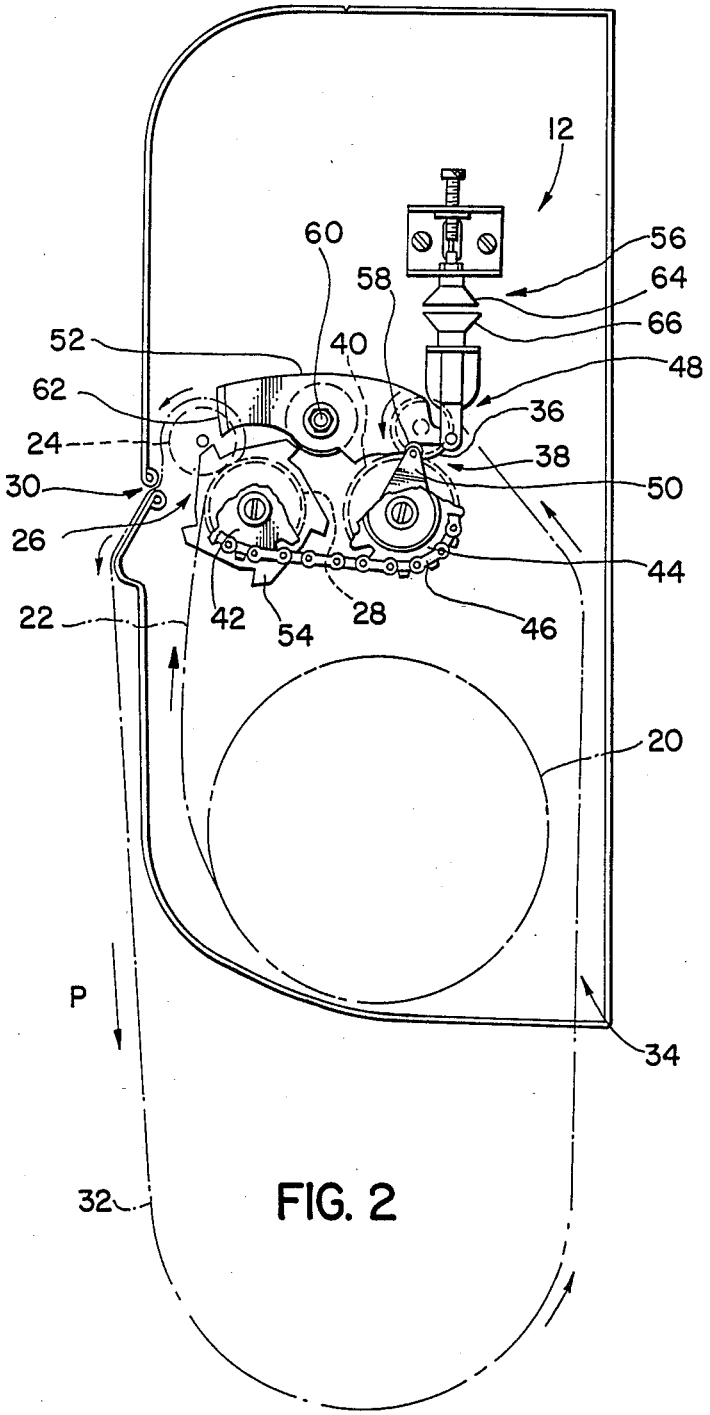
FIG. 2 shows a sectioned side elevation view of a towel cabinet showing the path of a towel therethrough and some details of a limiting mechanism therefor. The profile of the cabinet shown in FIG. 2 differs from that of FIG. 1 but this is merely to show the application of the apparatus described herein to a variety of cabinet profiles.

As shown in FIG. 2 the path of a towel during use is as follows. The roll of clean towel 20 is contained in the cabinet lower portion or bottom bucket 18 and the towel extends from the roll in an upwards run 22 to a floating roller 24. The towel passes into the nip 26 between floating roller 24 and first main towel roller 28 and then passes anti-clockwise round floating roller 24 and downwards through the dispensing slot 30 in the cabinet and thence to the towel loop portion 32 where a user dries his or her hands on the towel. From loop 32 the towel passes upwards through a rear opening 34 back into the cabinet and passes anti-clockwise round a second floating roller 36 and into the nip 38 between floating roller 36 and a second main towel roller 40. The towel is mounted on floating roller 36 so as to wind-up thereon, and this roller thus provides towel take-up and the entire length of towelling is eventually wound onto roller 36 after use, the roller floating upwards to accommodate the increasing diameter of the roll of towelling thereon.

End sprockets 42 and 44 are provided at the ends of the main towel rollers 28 and 40 respectively, the sprockets being connected by a chain 46. As a result, a downward pull in the direction P by a user on the loop portion 32 of the towel causes floating roller 24 to press against roller 28 so that the towel is firmly gripped between rollers 24, 28 and drive is transmitted to roller 28 and thence via chain 46 to the second main towel roller 40. The latter roller frictionally engages the second floating roller 36 causing the latter to rotate and to take-up the used towelling at the same rate that it is dispensed, whereby towel loop 32 remains at a constant length throughout the period of use.

A limiting mechanism 48 is provided to limit the length of towel which can be obtained by a user at a single pull on towel loop portion 32.

Limiting mechanism 48 comprises a roller cam arm 50 rotatable with sprocket 44 on the second main towel roller 40, a pivoted stop lever 52, a ratchet wheel 54 and a delay mechanism 56. Cam arm 50 engages a cam surface 58 on stop lever 52 so as to pivot the latter anti-clockwise about pivot axis 60, thereby bringing stop 62 at the end of lever 52 into engagement with one of the teeth of ratchet wheel 54 and also bringing suction cups 64, 66 of delay mechanism 56 into vacuum engagement. In this condition, the towel rollers are prevented from rotating and the user can obtain no more clean towelling. After a short delay, the vacuum between suction cups 64, 66 collapses, the suction cups part and stop lever 52 returns to the position shown in FIG. 2 and further towel can be obtained by the next user.

The present invention is concerned in this embodiment with the construction of the first and second main towel rollers 28 and 40, the floating rollers 24 and 36 being of plastics material with a smooth surface finish. However, the roller constructions described below in relation to the first and second main rollers could likewise be adopted for the floating rollers, with modifications if necessary or if desired.

The structure and arrangement of the main towel rollers will now be described with reference to FIGS. 3, 4 and 5.

First and second main towel rollers 28 and 40 are of substantially identical construction and therefore only one of them will be described. As shown in the drawings, roller 28 comprises a tubular roller body portion 70, end supports 72, 74 and towel-engageable bands 76, 78.

Roller body portion 70 is formed from polyvinylchloride, or other suitable plastics material or mixture of such materials whether reinforced or otherwise, and is of tubular cylindrical form with a smooth cylindrical external surface 80. Roller body portion 70 may be formed as an extruded tube which is cut to length for roller construction purposes, or a solid cylinder may be used instead.

Four axially extending grooves or flutes 82 are formed in the surface 80 of roller body portion 70 at equally circumferentially spaced intervals around the periphery thereof. Each groove extends along the full length of body portion 70 and is of generally V-shaped cross section and of depth approximately half the thickness of the material of body portion 70, as shown in FIG. 5.

End supports 72, 74 are each in the form of a moulded plastic component formed in one piece from nylon or an alternative plastics material and serve to support roller 28 for rotation about its longitudinal axis 84 in bearing assemblies (not shown) carried by end plates 86, 88 of the towel dispensing apparatus 12.

Each end support comprises an end cap 90 moulded in one piece with a stub shaft 92. End caps 90 are shaped and proportioned to fit into the inside surface 94 of roller body portion 70 and are bonded or welded thereto so that stub shafts 92 are co-axial.

Towel-engageable bands 76, 78 are identical in structure and each comprises a fluted or ribbed portion 96 for engagement with a towel being dispensed, and 4 internal ribs 98 for entry into and driving engagement with grooves 82 in surface 80 of roller body portion 70.

Bands 76, 78 are formed of natural rubber. Other elastomeric materials or combinations thereof may be devised which are suitable, including synthetic elastomers, with a variety of surface patterns or treads formed on the external towel-engaging surfaces of the bands.

Figure 5:
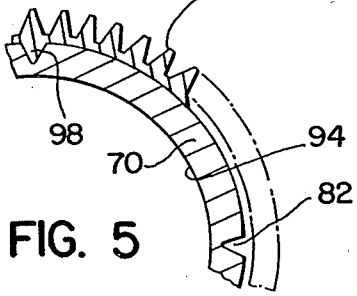
FIG. 5 shows, on a larger scale, a section through the roller of FIG. 4 on the line V—V in FIG. 4.

FIG. 5 shows the structure of the axially extending ribs 100 formed on the external surface of band 76, 78. The ribs extend along the full axial length of each band and provide a high friction surface for engagement with and gripping of the towel being dispensed. Internal ribs 98 enter grooves 82 in the roller and provide positive mechanical transmission of drive from the roller body portion to the bands themselves, without the use of any adhesive. It will be noted that the axial length of the internal ribs 98 is less than the full axial length of the bands, and indeed is less than half such axial length, which simplifies manufacture and assembly.

Figure 4:
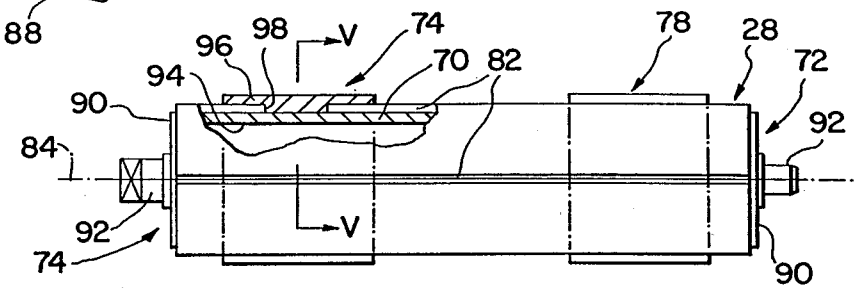
FIG. 4 shows a side elevation view, partly sectioned, of a dispensing roller of the mechanism of FIG. 3.

Assembly of the bands 76, 78 onto roller body portions 70 is by an axial sliding movement from the roller ends to the positions shown in FIG. 4.

In use, a pull by a user on loop 32 of the towel causes a downward load on floating roller 24, thereby squeezing the towel between the latter roller and first main towel roller 28. The ribs surface of bands 76, 78 on the latter roller frictionally engage and grip the towel whereby the roller rotates anti-clockwise, as seen in FIG. 2 and clean towel is dispensed through slot 30 and chain 46 transmits drive to sprocket 44 and hence to the stub shaft 92 at that end of second main towel roller 40.

After a predetermined length of towel has been dispensed, limiting mechanism 48 stops rotation of the rollers 28, 40, then, after a short delay, further towel can be obtained by another user.

The used towel passes around the second floating roller 36 and is wound up thereon. The drive transmitted to second main roller 40 causes the latter to rotate and the ribs 100 on its bands 76, 78 engage and grip the towel and cause it to be positively wound onto roller 36 at the same rate that the towel is dispensed through slot 30. Eventually the entire towel becomes, after use, wound onto roller 36.

Among the advantages provided by the embodiment of the invention described above are the improved frictional grip provided between the main towel rollers and the towel, the simple construction of the rollers and the fact that they can readily be substituted in existing towel dispensing mechanisms for the previously used rollers. Moreover, the rollers 28, 40 are simple and relatively inexpensive to manufacture and assemble, avoiding the use of any significant amounts of adhesive and the like.

Moreover, the use of the moulded end support 72, 74 formed of a plastics material further simplifies manufacture. Previous roller constructions have involved fabrication of the end supports from a number of metal components. Such fabrication has inherently tended to introduce tolerances in the roller construction. The use of moulded end suports as described above reduces significantly the likelihood of unacceptable tolerances being introduced in the end support assembly.

Many modifications can be made in the above-described embodiment while remaining within the scope of the invention. As regards the bands, 76, 78 these could be modified by the use of 3 or more such bands. The form of the ribs 100 may be varied considerably and many other surface patterns or treads may be found to be acceptable, including non-axial formations.

As regards the internal ribs 98, the number of these may be varied down to one only and more than 4 may be employed if desired. The ribs may extend along a greater or smaller proportion of the axial length of the bands than that shown in FIG. 4, and other methods of mechanically keying the bands to the roller body portions may be employed. Indeed, mechanical keying is not an essential feature of the invention and a drivable coupling may be provided by other mechanical means. For example, it may well be possible to provide for the band or bands to be a tight fit on and grip the roller body portions.

Figure 3:
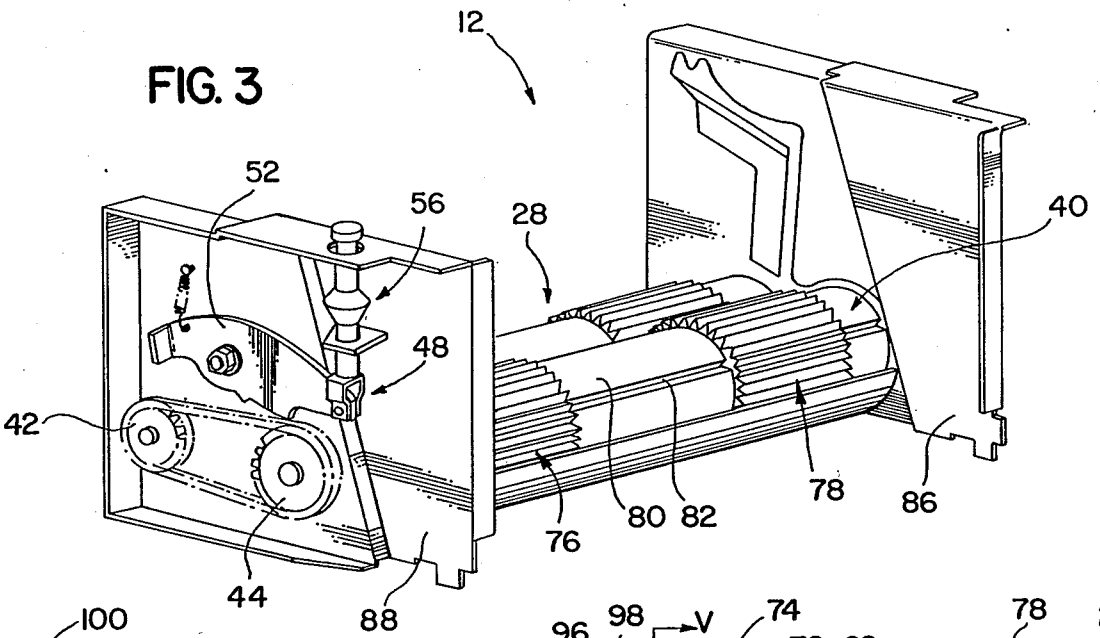
FIG. 3 shows a perspective view of towel dispensing apparatus, with certain parts of the apparatus indicated diagrammatically.

The invention is of course applicable to many different kinds of towel dispensing mechanism other than the particular one described in relation to FIGS. 2 and 3.

I claim:

1. In a towel dispensing apparatus having a cabinet for containing a roll of clean towel material to be dispensed and for receiving the towel material after it has been dispensed, takeup means for pulling dispensed towel material into said cabinet in response to the dispensing of clean towel material from the roll contained within said cabinet and including a takeup roller disposed within said cabinet onto which towel material is progressively wound during the use of the apparatus, said towel material extending from said roll to said takeup roller through openings in said cabinet and forming a loop outside of said cabinet between said roll and said takeup roller where it is available for use, roller means including a pair of rollers journalled for rotation within and relative to said cabinet and defining a nip therebetween through which said towel material extends for transmitting driving driving force to one of said two rollers as towel material moves through said nip in response to a pull on the material forming the loop, and a control mechanism operable in response to rotation of said one roller for controlling the dispensing of towel material from said cabinet the further improvement comprising at least one of said two rollers having a generally cylindrical tubular body made from plastic material, said tubular body having a plurality of equangularly spaced generally v-shaped grooves formed therein and opening radially outwardly through the peripheral surface thereof, said grooves extending axially of said tubular body and opening outwardly through at least one end thereof, means for supporting said tubular body within said cabinet and including a pair of end caps made from plastic material, each of said end caps having a cylindrical portion thereof received within an associated end portion of said tubular body and including an integral outwardly projecting stub shaft, means for bonding said end caps coaxially to said tubular body with the stub shafts of said end caps coaxially aligned, and at least two bands of elastomeric material mounted on said tubular body portion in coaxially surrounding relation with associated axially spaced apart portions of said tubular body, each of said bands frictionally engaging said tubular body and having a surface pattern formed on its radially outwardly facing surface for driving engagement with towel material to be dispensed, each of said bands having means for a drivingly coupling it to said roller body portion and including integral generally V-shaped projections extending radially inwardly from the inwardly facing surface of said bands, each of said V-shaped projections extending in an axial direction and being received within and generally complementing an associated portion of one of said grooves, each of said projections being spaced inwardly from the ends of said band and having an axial length less than one half of the axial length of said band.

* * * * *